US006766743B2

(12) United States Patent
Hayashi et al.

(10) Patent No.: US 6,766,743 B2
(45) Date of Patent: Jul. 27, 2004

(54) METHOD FOR ADJUSTING TEMPERATURE OF PRINTING PRESS AND APPARATUS THEREFOR

(75) Inventors: Kenji Hayashi, Yokohama (JP); Mineo Matsuzaki, Yokohama (JP)

(73) Assignee: Toyo Seikan Kaisha, Ltd., Tokyo (JP)

( * ) Notice: Subject to any disclaimer, the term of this patent is extended or adjusted under 35 U.S.C. 154(b) by 14 days.

(21) Appl. No.: 10/154,785

(22) Filed: May 28, 2002

(65) Prior Publication Data

US 2002/0178954 A1 Dec. 5, 2002

(30) Foreign Application Priority Data

May 29, 2001 (JP) ..... 2001-160038

(51) Int. Cl.[7] ..... B41F 23/04

(52) U.S. Cl. ..... 101/487; 101/38.1; 101/488; 101/424.1

(58) Field of Search ..... 101/38.1, 487, 101/488, 424.1

(56) References Cited

U.S. PATENT DOCUMENTS

| | | | | | |
|---|---|---|---|---|---|
| 3,956,986 | A | | 5/1976 | Wirz et al. | |
| 5,146,279 | A | * | 9/1992 | Seyfried | 399/93 |
| 5,189,960 | A | * | 3/1993 | Valentini et al. | 101/487 |
| 5,309,838 | A | | 5/1994 | Kurz | |
| 5,603,261 | A | * | 2/1997 | Buenz | 101/216 |
| 5,694,848 | A | * | 12/1997 | Palmatier | 101/219 |
| 6,109,177 | A | * | 8/2000 | Wech et al. | 101/349.1 |
| 6,164,199 | A | * | 12/2000 | Dubuit et al. | 101/38.1 |
| 6,209,456 | B1 | * | 4/2001 | Murray et al. | 101/487 |
| 6,550,389 | B1 | * | 4/2003 | Goto et al. | 101/483 |

FOREIGN PATENT DOCUMENTS

| | | |
|---|---|---|
| DE | 19736339 A1 | 8/1997 |
| JP | 64-072846 | 3/1989 |
| JP | 06-344538 | 12/1994 |
| JP | 2572516 | 10/1996 |
| JP | 08-290550 | 11/1996 |
| JP | 11-105261 | 4/1999 |

* cited by examiner

*Primary Examiner*—Daniel J. Colilla
*Assistant Examiner*—Andrea H. Evans
(74) *Attorney, Agent, or Firm*—Rader, Fishman & Grauer PLLC

(57) ABSTRACT

A method and apparatus are provided for adjusting the temperature of a printing press, which can effectively adjust the temperature of plate cylinders and rollers in each inking arrangement in a press for multicolor printing on cylindrical bodies and make it possible to conduct the printing, without the appearance of scumming even in waterless offset printing presses. A first system conduit 25 for adjusting the temperature of rollers with an ink feed function in each inking arrangement and a second system conduit 26 for adjusting the temperature of rollers with an ink distribution function are provided, the temperature can be adjusted separately in the first system conduit and second system conduit, and plate cylinders 2 are cooled by blowing cooling air whose temperature is set to a prescribed temperature from axially extending portion of the plate cylinders in the axial direction of the plate cylinders.

14 Claims, 4 Drawing Sheets

METHOD FOR ADJUSTING TEMPERATURE OF PRINTING PRESS AND APPARATUS THEREFOR

BACKGROUND OF THE INVENTION

1. Field of the Invention

The present invention relates to a method for adjusting the temperature of a printing press and an apparatus therefor, and more specifically to a method for adjusting the temperature of a printing press by which the temperature of inking rollers or printing plate surface is adjusted to suppress the decrease in ink viscosity caused by ink temperature increase during printing, and to an apparatus therefor.

2. Description of the Related Art

During the operation of printing presses, the temperature of inking rollers or printing plate surface gradually increases and ink viscosity decreases under the effect of friction heat or the like. As a result, a variety of adverse effects are produced on printing quality. Those effects are especially significant in waterless offset printing presses, where the viscosity of ink decreases, the repellency drops, and the so called "scumming" appears in non-image areas owing to temperature increase. For this reason, various methods and apparatuses for adjusting the temperature of printing presses for the purpose of preventing temperature increase in inking arrangements and printing plate surfaces have been suggested for the usual offset presses.

Conventional cooling apparatuses for inking arrangements typically suppress the increase in temperature of rollers by passing cooling water inside base rollers or vibrator rollers of inking arrangements (for example, Publications of Japanese Patent Application No. H8-29550, H6-344538 and so on). Direct blowing of cooling air on a printing plate surface was also suggested as a method for cooling the printing plate surface (for example, Japanese Patent No. 2572516, Publication of Japanese Patent Application H1-72846 and so on).

However, in the conventional cooling apparatuses for inking arrangements, it was difficult to control the temperature of a roller group constituting the inking arrangement, so as to maintain separately the optimum temperature of each roller according to the function thereof, and a cooling apparatus demonstrating a satisfactory temperature adjustment function has not yet been developed. Furthermore, in case of printing presses in which a plurality of inking arrangements are disposed around one blanket wheel and multicolor printing is conducted on a cylindrical body, all inking arrangements have different degrees of temperature increase owing to the difference in the ink build-up depending on the design of each color or because of the difference in setting state between the inking arrangements (for example, lubrication state in bearing units). However, in prior art, the temperature adjustment of inking rollers for each inking arrangement has not been conducted based on the increase in temperature of each inking arrangement. Furthermore, a problem associated with the method of blowing cooling air onto a printing plate surface for cooling thereof is that transfer defects caused by ink drying on the printing plate surface can easily occur. Thus, the problem is that the conventional methods for adjusting the temperature of printing presses have not yet provided a satisfactory temperature adjustment function, and in the waterless offset printing presses requiring an especially sensitive temperature adjustment, a scumming effect caused by the decrease in repulsiveness in non-image areas could easily occur.

Waterless lithographic printing was recently tested as a method for printing on cans to meet the demand for diversified printing patterns on cylindrical cans. However, technological problems requiring resolution, such as a decrease in yield caused by the above-described scumming effect, were encountered.

SUMMARY OF THE INVENTION

The present invention is aimed at the resolution of the above-described problems, and it is an object of the present invention to provide a method and apparatus for adjusting the temperature of a printing press that can provide for reliable temperature adjustment of the printing press, can be used to adjust the temperature according to the temperature increase of inking arrangements of each color in case of multicolor printing, generate no transfer defects caused by ink drying, even in temperature adjustment of printing plates, allow for optimum cooling, and make it possible to obtain good printing quality, without scumming even in waterless lithographic printing.

The method for adjusting the temperature of a printing press in accordance with the present invention, which resolves the above-described problems is a method for adjusting the temperature of a printing press in which the temperature is adjusted by passing a temperature-adjusting water to the shaft portion of rollers of inking arrangements, wherein the roller groups of inking arrangements are divided into a first system in which the temperature of rollers with an ink feed function is adjusted and a second system in which the temperature of rollers with an ink distribution function is adjusted and temperature adjustment can be conducted separately for the first system and second system. Passing the temperature-adjusting water is not necessarily conducted to all of the rollers constituting the rollers with an ink feed function and rollers with an ink distribution function. Thus, the water may be supplied to a fountain roller and a transfer roller of the rollers with an ink feed function and to three vibrator rollers of the rollers with an ink distribution function. Further, in the first system, the temperature of the rollers with an ink feed function by virtue of adjusting the water temperature at a constant flow rate of temperature-adjusting water passing through the shaft portion of the rollers is preferably adjusted, and in the second system, the temperature of rollers with an ink distribution function is preferably adjusted by virtue of adjusting the water temperature for a constant value for each operation state and also by adjusting the water flow rate for each inking arrangement.

The present invention can be applied to a printing press for multicolor printing on cylindrical bodies, in which a plurality of inking arrangements are disposed around one blanket wheel. In such a case, the inking arrangements of each color are preferably controlled with one temperature adjustment apparatus, and in the second system, the temperature preferably can be adjusted for each inking arrangement of each color.

With another method for adjusting the temperature of a printing press in accordance with the present invention, the plate cylinder is cooled by blowing cooling air in the axial direction of the plate cylinder from the axial extension of the plate cylinder. Further, the temperature adjustment of a printing press can be conducted more effectively by employing together the method for cooling the rollers of the first system and second system of the color inking arrangements and the method for cooling the plate cylinder by blowing cooling air in the axial direction of the plate cylinder. The above-described methods can be effectively applied to waterless offset printing presses.

In the apparatus for adjusting the temperature of a printing press in accordance with the present invention, the conduit for passing the temperature-adjusting water to a roller group in an inking arrangement is divided into a first system conduit for adjusting the temperature of rollers with an ink feed function and a second system conduit for adjusting the temperature of rollers with an ink distribution function, pumps and heaters are provided separately for the first system conduit and second system conduit, and the first system conduit and second system conduit have an apparatus for roller temperature adjustment in an inking arrangement which is capable of separate temperature adjustment.

In the above-mentioned first system conduit and second system conduit, the pumps, heaters, and valves for adjusting the amount of supplied cooling water from the cooling water source which are used commonly for inking arrangements of all colors are provided in respective supply-side conduit of the first system integrated conduit and second system integrated conduit that are integrated with the first system conduit and second system conduit having the upstream sides thereof enclosed inside one temperature adjustment unit, and the respective temperatures of temperature-adjusting water can be controlled by one temperature adjustment unit according to the operation state. Furthermore, a flow rate adjustment valve is provided for each second system conduit of the inking arrangements of each color branched from the second system integrated conduit, the amount of water passed to the rollers of the second system are controlled for the inking arrangements of each color and the roller temperature in the second system can be controlled for each color inking arrangement.

Another apparatus for adjusting the temperature of a printing press in accordance with the present invention is an apparatus for adjusting the temperature of a printing press for multicolor printing on cylindrical bodies, in which a plurality of inking arrangements are disposed around one blanket wheel, this apparatus comprising a plate cylinder shaft forced air cooling unit in which a chamber is provided opposite a side surface of the blanket wheel on the axial direction side thereof, air cooling ducts are provided which extend from the chamber toward the center of the plate cylinder center of each color, and air cooling openings for blowing cooling air toward the plate cylinder shaft are provided at the ends of the air cooling ducts.

The air cooling ducts are preferably provided so that they can be shifted to a position in which they place no obstacle during setup or adjustment of the plate cylinder and to a position in which the air cooling openings face the plate cylinder axis during printing. Providing the apparatus for adjusting the temperature of inking arrangements and the plate cylinder shaft forced air control apparatus makes it possible to obtain the temperature adjustment apparatus with even better temperature adjustment effect. Utilizing such a waterless offset printing press, in particular, for waterless lithographic printing on cans makes it possible to suppress the appearance of scumming and to increase printing quality in waterless lithographic printing on cans.

DESCRIPTION OF THE PREFERRED EMBODIMENT

An embodiment of the present invention will be described in detail hereinbelow with reference to the appended figures.

Figure 1:
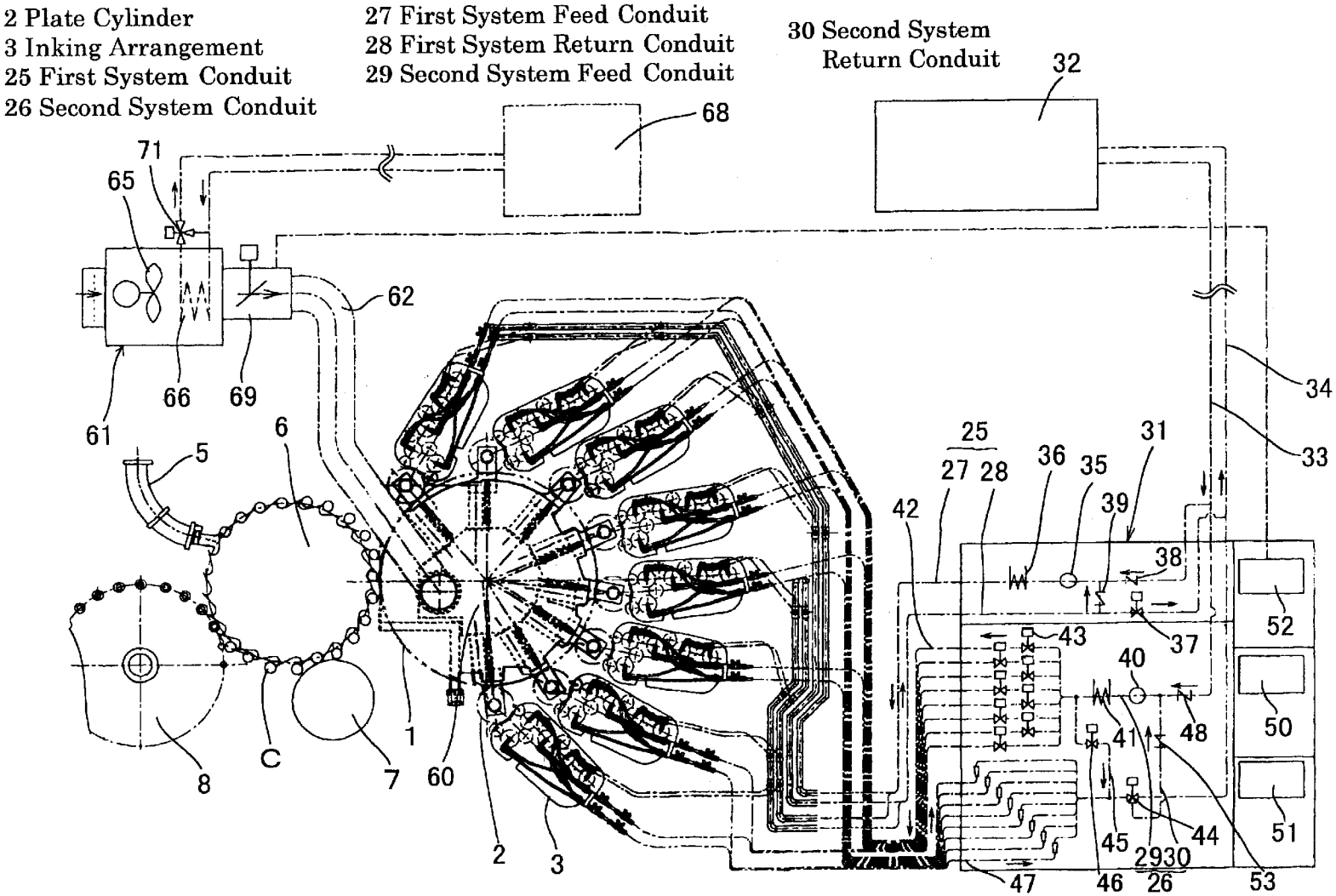
FIG. 1 is a schematic view illustrating the system configuration of the apparatus for adjusting the temperature of a waterless offset printing press for cans which conduct printing on body surface of cylindrical cans, this apparatus representing an embodiment of the present invention.
Figure 2:
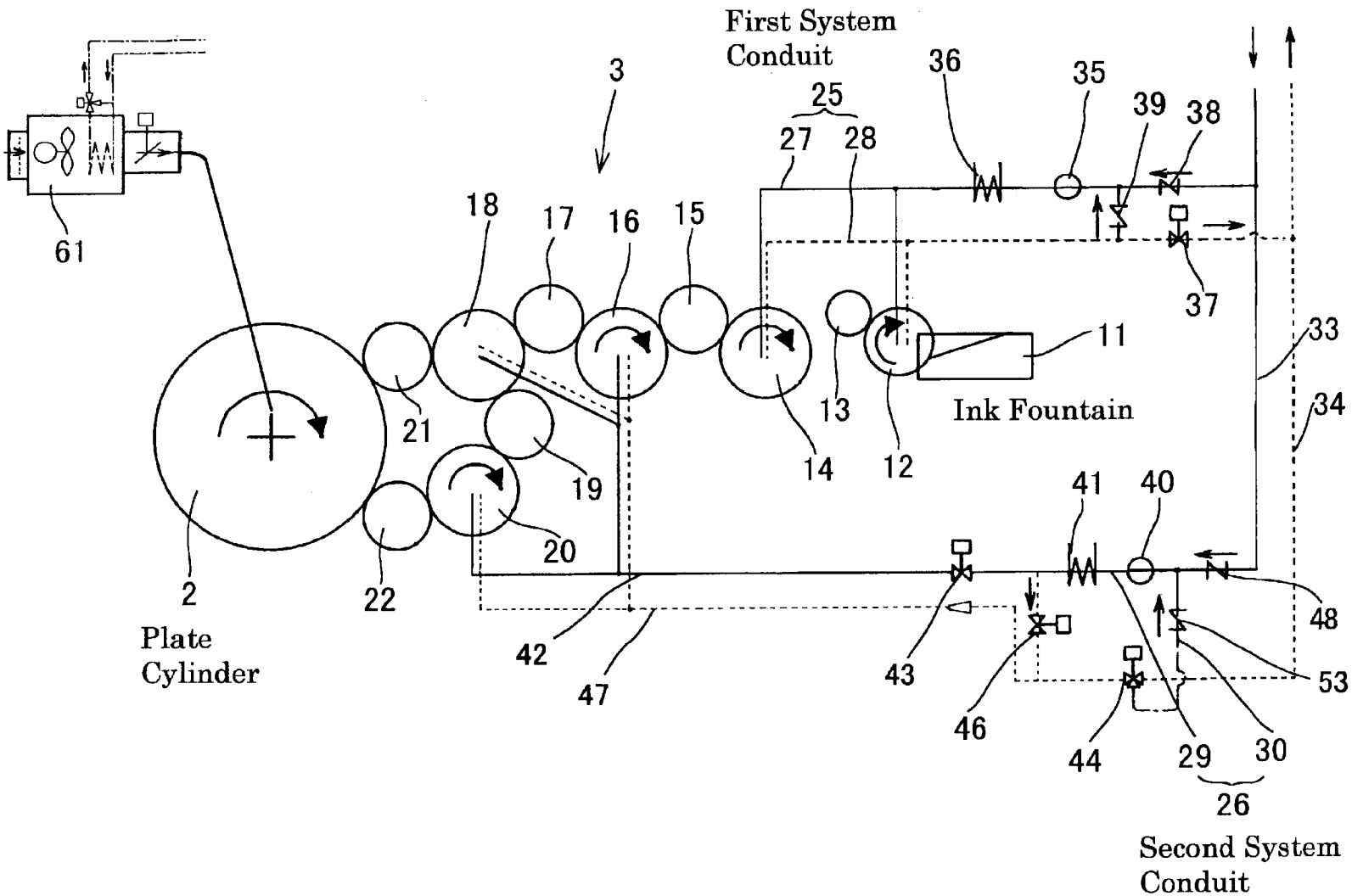
FIG. 2 is a schematic view illustrating the conduit of the temperature adjustment apparatus in a single inking arrangement.
Figure 3:
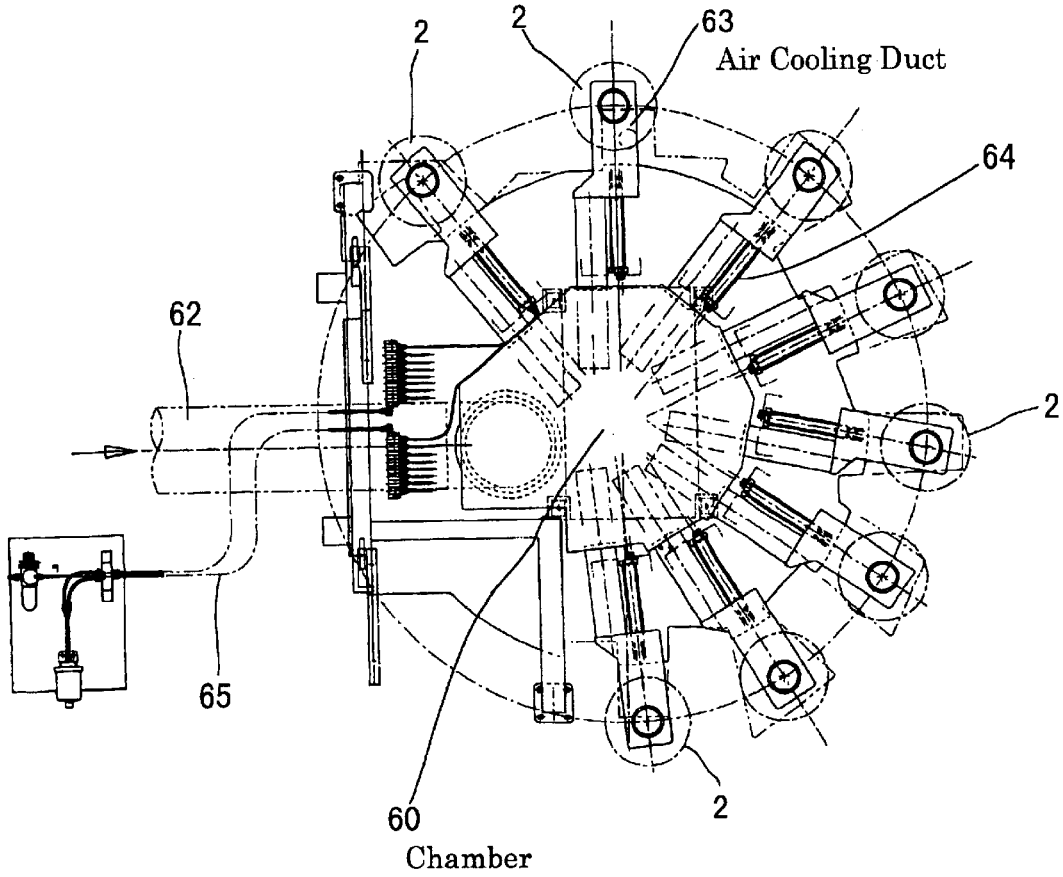
FIG. 3 is a schematic view illustrating the apparatus for forced air cooling of plate cylinder.
Figure 4:
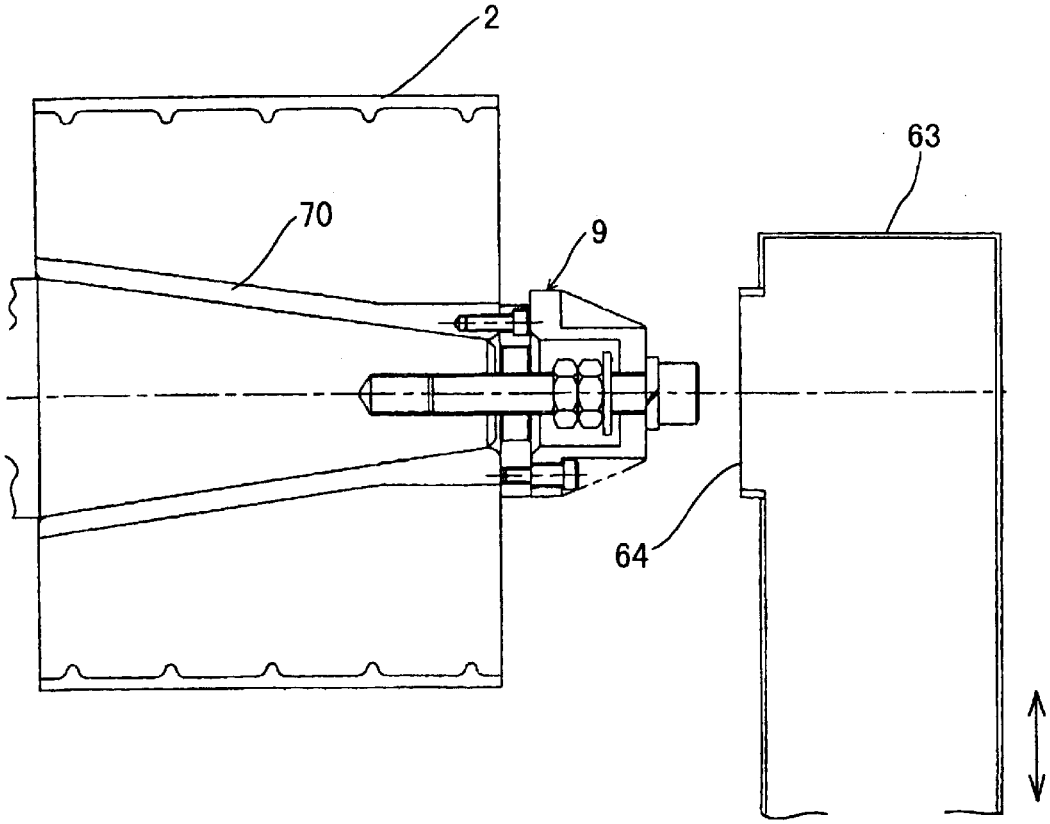
FIG. 4 is a front sectional view of a plate cylinder and an air cooling duct in a state in which the air cooling duct is in a position in which the plate cylinder is cooled.

FIG. 1 is a schematic view illustrating the system configuration of the apparatus for adjusting the temperature of a waterless offset printing press for cans which conducts printing on body surface of cylindrical cans, this apparatus representing an embodiment of the present invention. FIGS. 2 through 4 are fragmentary detailed views of the system configuration.

The waterless offset printing press of the present embodiment is a waterless offset printing press capable of eight-color overlapping printing and comprising eight plate cylinders 2 arranged in fixed positions around a blanket wheel 1 shown by a dash-dot line. Inking arrangements 3 of each color are disposed at each plate cylinder as shown in the figure. In such a waterless offset printing press, a plate with a design image of respective colors is installed at each plate cylinder 2, ink is transferred from the inking arrangements 3 provided on the outer periphery of each plate cylinder by the rotation of the plate cylinder and ink is caused to adhere to places corresponding to the printing area of each plate. Therefore, if the blanket wheel 1 is rotated, the blanket surface installed on the blanket wheel and the printing plate surface are successively brought in rotary contact and a multicolor image is applied to the blanket surface.

On the other hand, cans C formed in preprocessing so as to have an open-end cylindrical shape are supplied from a chute 5 to a turret wheel 6 and fit and transferred onto a mandrel of a mandrel wheel (not shown in the figure) by the rotation of the turret wheel. The image present on the blanket is then transfer printed on the cylindrical surface of the cans by rotary contact of the cans with the rotating blanket wheel. The reference numeral 7 stands for an applicator roller for coating a finishing varnish on the can subjected to printing. The reference numeral 8 stands for a transfer disk which is used to hold the cans that were subjected to printing and coated with the finishing varnish, and to transfer them to subsequent processing, without contact with the outer surface thereof.

In the press for waterless lithographic of cans, which has the above-described configuration, the present invention provides a temperature adjustment apparatus composed of the below-described apparatus for adjusting the temperature of rollers in each color inking arrangement and an apparatus for forced air cooling of plate cylinders for each color, so as to maintain the ink temperature at a correct level and to prevent the appearance of scumming caused by changes in the temperature of printing press during printing. Apparatus for adjusting the temperature of rollers in inking arrangements FIG. 2 schematically illustrates the apparatus for adjusting the temperature of inking arrangements of each color. In the inking arrangement 3 of each color, of the roller group composed of a fountain roller 12, ductor roller 13, transfer roller 14, distributor roller 15, vibrator roller 16, distributor roller 17, vibrator roller 18, distributor roller 19, vibrator roller 20, and form rollers 21, 22 which are successively located between an ink fountain 11 and the plate cylinder 2, the rollers from the fountain roller 12 to the transfer roller 14 are the rollers with an ink feed function demonstrating the function of ink feeding from the ink fountain, and the distributor roller 15 and subsequent rollers are the rollers with an ink distribution function mainly demonstrating the ink distribution function.

In the above-described inking arrangement, in the present embodiment, the rollers whose temperature is adjusted are divided into two systems. The first system is composed of the fountain roller 12 and transfer roller 14 of the rollers with an ink feed function, and the second system is composed of the vibrator rollers 16, 18, 20 of the roller with an ink distribution functions. The temperature adjustment of those rollers is conducted by using temperature-adjusting water as a temperature-adjusting medium and passing the temperature-adjusting water to the axial central portion of the rollers. In the first system, the temperature adjustment of fountain roller 12 and transfer roller 14 is conducted by fixing the amount of water and adjusting the water temperature according to the operation state of the printing press, while monitoring the water temperature. In the second system, the temperature adjustment is conducted by the amount of water passed to the vibrator rollers 16, 18, 20, while adjusting the temperature of the temperature-adjusting water serving as a temperature-controlled medium according to the operation state of the printing press and also monitoring the surface temperature of form rollers 21, 22 which are in contact with the vibrator rollers.

The temperature adjustment conduit configuration of the entire printing press employed therefor is shown in FIG. 1. FIG. 2 schematically illustrates a single inking arrangement removed therefrom. A water feed conduit is shown by a solid line in FIG. 2, and a return conduit is shown by a broken line. As shown in FIG. 1, the first system conduits 25 and second system conduits 26 of eight inking arrangements are collected and unified into one conduit of each type (first system integrated conduit and second system integrated conduit) inside an inking arrangement temperature adjustment unit 31. The base end portions of both the first system conduits 25 and second system conduits 26 are connected to a feed base pipe 33 and return base pipe 34 connected to a cooling water feed tank 32.

A pump 35 and a heater 36 common for eight inking arrangements are provided in the first system feed conduit 27. They are connected to the shafts of fountain rollers 12 and transfer rollers 14 of each inking arrangement. The first system return conduit 28 is connected to the other end of the shafts, and the temperature-adjusting water circulates to the first system feed conduit 27 via the connection conduit provided with a switch valve 39. The temperature of the temperature-adjusting water is constantly monitored with a temperature sensor disposed in the first system return conduit (the monitoring is not illustrated by the figure). In order to control the temperature to the randomly set value according to the operation state, if necessary, a heater is actuated, and the cooling water feed amount adjustment valve 37 installed in the first system return conduit is opened, if necessary, to introduce cooling water from the cooling water feed tank. The reference numerals 38, 39 in the figure stand for switch valves which are opened and closed as necessary. The results of monitoring the temperature of the temperature-adjusting water are sent to a first conduit control panel 50 and displayed thereon allowing for constant monitoring during printing.

A pump 40 and a heater 41 common for eight inking arrangements are installed in the second system feed conduit 29, and the conduit downstream thereof is branched into eight second system branched feed conduits 42, each of the branches being provided with a flow rate control valve 43, which makes it possible to control individually the flow rate of cooling water to each inking arrangement.

The second system branched feed conduits 42 are further branched into three conduits at the downstream side thereof and connected to shafts of the three vibrator rollers 16, 18, 20 of each inking arrangement, feeding the cooling water into the rollers. The return conduits 47 are connected to the other end portions of the three vibrator roller shafts, and the eight second system branched return conduits are collected into one second system return conduit 30 and connected to the feed conduit. The temperature of the temperature-adjusting water inside the second system integrated conduit is monitored with a temperature sensor and controlled to the temperature set according to the operation conditions of the printing press by introducing the cooling water with controlled flow rate from the heater 41 and cooling water tank 32 in a three-way valve 44 via the feed base pipe 33. Furthermore, if necessary, the downstream sides of the second system branched feed pipes 42 are connected to any number of vibrator roller shafts and not necessarily to the three vibrator roller shafts, and both the serial connection and the parallel connection method can be used. The switch valves 48, 53 are opened and closed as necessary.

Temperature sensors (not shown in the figure) are provided for detecting the surface temperature of form rollers 21, 22 which are in contact with the vibrator rollers 18, 20, the detection signals of the temperature sensors are sent to the second system conduit control panel 51, and the settings are such that the water temperature and water amount can be automatically controlled based on the detected temperature.

In other words, in the second system conduit, the circulating water is heated to the preset temperature with the heater 41, or the temperature of circulating water is adjusted by controlling the three-way-valve 44 for cooling water feed amount adjustment, and water with a temperature adjusted to the preset temperature according to the operation state is sent to the second system branched feed conduits that are branched for each inking arrangement. With the flow rate adjustment valves 43 provided in the second system branched feed pipes, the amount of water passing to the vibrator rollers of each inking arrangement is controlled by the detection signals from the surface temperature detection sensors of form rollers provided in each inking arrangement, which makes it possible to adjust individually the temperature of each vibrator roller.

If the flow rate adjustment valve 43 of each inking arrangement is opened or closed, the flow rate to other inking arrangements supposedly changes. In order to suppress such changes, the flow rate adjustment valve 46 is controlled to prevent the interference of flow rates of inking arrangements.

The inking arrangement temperature adjustment unit 31 is provided with a first system conduit control panel 50, second system control panel 51, and the below-described plate cylinder air cooling control panel 52, and the respective control values can be set. Further, among the rollers constituting an inking arrangement, the rollers other than those rollers that belong to the first system and second system and whose temperature is forcibly adjusted with temperature-adjusting water may have the usual structure, but the cooling effect is preferably further increased by employing self-cooling rollers suggested by the assignee in Publication of Japanese Patent Application No. H11-105261.

Plate Cylinder Shaft Forced Air Cooling Apparatus

In the forced air cooling apparatus for plate cylinder for each color, as shown in FIG. 1 and FIG. 3, a fixed chamber 60 is provided so as to face one end of the blanket wheel 1 of the printing press in the axial direction, cold air is introduced into the chamber from the air cooling unit 61 via a duct 62 and this cold air is blown in the direction of plate cylinder shaft, thereby forcibly air cooling the plate cylinder. Air cooling ducts 63 (a total of eight ducts in the present embodiment) extending so as to face the shaft ends of plate cylinders are disposed in the chamber 60. The air cooling ducts can be extended and contracted. During set-up or adjustment of plate cylinders, the ducts are contracted so as not to inhibit the operations, whereas during printing, the ducts are extended to the preset positions so that the air cooling openings 64 face the plate cylinder shafts 9, as shown in FIG. 4. Connecting an actuation air piping 65 to an air cylinder 64 for each air cooling duct 64, as shown in FIG. 3, and switching the switches with the plate cylinder air cooling control panel 52 can be used as means for extending and contracting the air cooling ducts 63, that allows the ducts to be freely set into extended position and contracted position.

No specific limitation is placed on the structure of air cooling unit 61, provided that it generates a cooling flow whose temperature can be randomly controlled. In the present embodiment, a heat exchanger 66 is installed downstream of the fan, and cooling water is circulated form the cooling duct 68 provided with a cooling/heating source, which makes it possible to cool the air and blow it to the chamber 60 via the duct 62. The reference numeral 69 stands for an air amount control valve. The above-described air cooling unit can be controlled from the plate cylinder air cooling control panel 52.

Furthermore, in the present embodiment, a self-cooling body plate heretofore suggested by the assignee (Publication of Japanese Patent Application No. H10-193557) is used as the plate cylinder 2 to further increase the cooling effect. Such a plate cylinder has a structure in which the outer peripheral portion of hub 70 located inside the plate cylinder is tapered so that the free end side of the cantilevered plate cylinder shaft 9 has a small diameter and the diameter gradually increases toward the supported end. Under the effect of the linear velocity difference created by the tapered shape inside the plate cylinder, an air flow is generated from the shaft free end side in the suction direction and the inside of the plate cylinder is air self-cooled. Such a structure makes it possible to suck effectively the cooling air from the air cooling duct and to cool the inside of the plate cylinder more effectively.

The configuration of the apparatus for adjusting the temperature of a press for waterless lithographic printing on cans of the present embodiment was described above. In such an apparatus. The temperature of water in the cooling water feed tank 32 is set to about 7° C., the temperature of water passing through the first system conduit is set to 35–38° C., and the temperature of water in the second system conduit is set to 14–30° C. Those temperature ranges differ depending on the printing system and ambient temperature. It is usually preferred that in waterless offset printing presses the temperature of both systems be within the above-mentioned ranges. Since ink supply from the ink fountain is made difficult if the temperature of the first system is decreased, setting the temperature of the first system higher than the temperature of the second system provides for control increasing the temperature of the fountain roller, improving flowability of the ink, cooling the second system, whose temperature gradually increases, to a low temperature, and preventing the unnecessary decrease of ink viscosity. Thus, conducting temperature control of rollers in inking arrangements separately for two systems makes it possible to control the ink temperature in a more desired form according to the state of transfer from the ink fountain to the plate cylinder.

In the present embodiment eight inking arrangements can be temperature controlled individually with one temperature adjustment unit. In the first system conduit, the rollers from the fountain roller 12 to the transfer roller 14 are within the zone from the ink fountain to the ink pick-up portion. Therefore, the rollers have to be maintained at a comparatively high temperature. In the present embodiment he respective temperature control is conducted integrally for eight ink units. Thus, the circulating water is heated and its temperature is adjusted to the prescribed temperature with the heater 36 of the first system conduit, and passing water to the shafts of the fountain rollers 12 and transfer rollers 14 controls the temperature of roller surface to the prescribed value. Water temperature in the return conduit is monitored and the heating temperature of the heater is automatically controlled by the signal thus detected. Furthermore, if necessary, cooling water is introduced and the surface temperature of rollers constituting the first system conduit can be maintained almost constant during the entire printing process.

Furthermore, in the second system conduit, the circulating temperature-adjusting water is sent to the second system branched feed conduits that are branched for each inking arrangement and the amount of water passing to the vibrator rollers is controlled for each inking arrangement by the flow rate control valve 43 provided in the second system branched feed conduit based on the detection signal from the sensors for detecting the surface temperature of form rollers provided in each inking arrangement, thereby making it possible to adjust separately the temperature of vibrator rollers. As described above, the temperature adjustment of a plurality of inking arrangements disposed around the blanket wheel was preferably conducted individually for each inking arrangement in the second system, whereas in the first system the adjustment was conducted integrally and the efficiency of the temperature adjustment apparatus could be increased.

Further, controlling the temperature and amount of air blown onto plate cylinders in the forced air cooling apparatus for the plate cylinders according to the operation state of the printing press provides for temperature adjustment of the plate cylinder surface. In case of waterless lithographic printing, the amount of air increases with the increase in speed of the printing press. The air temperature during waterless lithographic printing is controlled to any set temperature within a range from 15° C. to 20° C. Since cooling air is blown in the axial direction of plate cylinder, the cooling air is not brought in direct contact with the plate cylinder surface and the adverse effect of drying the ink present on the printing plate surface is not produced.

As described above, in the present embodiment, the temperature adjustment of the rollers of inking arrangements is conducted and also the plate cylinders are air cooled. Therefore, even during the utilization of a printing press, the rollers of the first system and second system of inking arrangements can be maintained at a temperature within a fixed range and the temperature of printing plate surface also can be maintained at a constant level. As a result, the decrease in viscosity of printing ink caused by temperature increase can be suppressed and constant-quality printing can be conducted at all times. With the press for waterless lithographic printing on cans of the embodiment shown in FIG. 1, continuous printing was conducted on 800,000 cans The plastic viscosity of ink during printing could be maintained within a range of 30–70 Pa-s and the appearance of scumming during printing was not observed. Further, the present invention is not limited to the above-described embodiment and various design modification can be introduced within the scope of the technological concept thereof. Moreover, the application of the present invention is not limited to the waterless offset printing presses and the present invention can be applied to printing presses of various types.

As described above, with the method and apparatus for adjusting the temperature of a printing press in accordance with the present invention, the group of rollers of an inking arrangement is divided into a first system and a second system that are temperature adjusted independently from each other. Therefore, the inking arrangements can be maintained at a roller temperature which is optimum for the roller functions of each system during printing process, the decrease in ink viscosity can be prevented, and good printing can be conducted. Furthermore, even in case of multicolor printing the temperature can be adjusted separately according to the temperature increase in each inking arrangement. Therefore, the control can be conducted separately according to the degree of temperature increase in each inking arrangement, which differs depending on the difference in the set state of rollers in the inking arrangements, and good multicolor printing can be conducted.

Further, blowing cooling air in the axial direction of plate cylinder makes it possible to cool the plate cylinder, without drying the printing plate surface, to maintain the temperature of the printing plate surface during printing within the fixed range, and to conduct good printing. Moreover, utilizing an apparatus for adjusting the temperature of rollers in inking arrangements and the apparatus for forced air cooling of plate cylinder in a waterless offset printing press conducting multicolor printing makes possible to eliminate "scumming" which poses a problem in waterless offset printing presses. Furthermore, the apparatus for adjusting the temperature of a printing press in accordance with the present invention allows the temperature of the inking plate cylinder to be controlled with a single temperature adjustment unit even in a multicolor printing presses. Therefore, the size of the apparatus can be reduced and its structure can be simplified.

What is claimed is:

1. A method for adjusting the temperature of a printing press, by which the temperature is adjusted by passing temperature-adjusting water into a shaft portion of rollers of inking arrangements, wherein the roller groups of inking arrangements are divided into a first system in which the temperature of rollers with an ink feed function is adjusted and a second system in which the temperature of rollers with an ink distribution function is adjusted and temperature adjustment is conducted separately for said first system and said second system, wherein in said first system, the temperature of the rollers with an ink feed function is adjusted by fixing the amount of temperature-adjusting water that is passed to the shaft portion of rollers and adjusting the water temperature, and in said second system, the temperature of the rollers with an ink distribution function is adjusted by adjusting the amount of water, with a water temperature set according to the operation state.

2. The method for adjusting the temperature of a printing press according to claim 1, wherein the rollers with an ink feed function of said first system are a fountain roller and a transfer roller, and the rollers with an ink distribution function of the second system are a plurality of vibrator rollers.

3. The method for adjusting the temperature of a printing press according to claim 1 or 2, wherein said printing press is an apparatus for multicolor printing on cylindrical bodies, in which a plurality of inking arrangements are disposed around one blanket wheel, in said first system, temperature adjustment is conducted integrally to the same temperature for each inking arrangement, and in said second system, temperature adjustment is conducted individually for each inking arrangement.

4. The method for adjusting the temperature of a printing press according to claim 3, wherein said printing press is a waterless offset printing press.

5. A method for adjusting the temperature of a printing press according to claim 1, wherein a plate cylinder is cooled by blowing cooling air in the axial direction of the plate cylinder from an axial extension of the plate cylinder.

6. A method for adjusting the temperature of a printing press according to claim 1, wherein a plate cylinder is cooled by blowing cooling air in the axial direction of the plate cylinder from an axial extension of the plate cylinder, and the temperature of rollers of inking arrangements is adjusted by passing temperature-adjusting water into a shaft portion of rollers of inking arrangements.

7. The method for adjusting the temperature of a printing press according to claim 6, wherein said printing press is a waterless offset printing press.

8. An apparatus for adjusting the temperature of a printing press, by which the temperature is adjusted by passing temperature-adjusting water into a shaft portion of rollers of inking arrangements, wherein the conduit for passing the temperature-adjusting water to a roller group in an inking arrangement is divided into a first system conduit for adjusting the temperature of rollers with an ink feed function and a second system conduit for adjusting the temperature of rollers with an ink distribution function, pumps and heaters are provided separately for said first system conduit and second system conduit, and an apparatus for adjusting the temperature of rollers in the inking arrangements is provided such that the temperature in said first system conduit and second system conduit is adjusted separately.

9. The apparatus for adjusting the temperature of a printing press according to claim 8, wherein said printing press is an apparatus for multicolor printing on cylindrical bodies, in which a plurality of inking arrangements are disposed around one blanket wheel, and the temperature of inking arrangements of each color can be adjusted.

10. The apparatus for adjusting the temperature of a printing press according to claim 9, wherein in the second system conduit of said inking arrangements of each color, a flow rate adjustment valve is provided for each inking arrangement of each color, and the amount of water passed to the rollers of the second system is controlled for each inking arrangement of each color, thereby making it possible to control the roll temperature in the second system for each inking arrangement of each color.

11. The apparatus for adjusting the temperature of a printing press according to claim 8 further comprising a plate cylinder shaft forced air cooling unit in which a chamber is provided so as to face a side surface on one side of a blanket wheel in an axial direction thereof, air cooling ducts are provided which extend from said chamber toward the shaft center of each plate so that cooling forced air enters respective ones of the plate cylinders, and air cooling openings for blowing cooling air toward the plate cylinder shaft are provided at the ends of said air cooling ducts.

12. An apparatus for adjusting the temperature of a printing press according to claim 10 or claim 11, wherein said printing press is a waterless offset printing press.

13. The apparatus for adjusting the temperature of a printing press for multicolor printing on cylindrical bodies, in which a plurality of inking arrangements are disposed around a blanket wheel, the apparatus comprising a plate cylinder shaft forced air cooling unit in which a chamber is provided so as to face a side surface on one side of the blanket wheel in an axial direction thereof, air cooling ducts are provided which extend from said chamber toward a shaft center of each plate cylinder so that cooling forced air enters respective ones of the plate cylinders, and air cooling openings for blowing cooling air toward the elate cylinder shaft are provided at the ends of said air cooling ducts.

14. The apparatus for adjusting the temperature of a printing press according to claim 13, wherein said air cooling ducts can be shifted to a position in which they do not inhibit the operation during set-up or adjustment of said plate cylinders and to a position in which said air cooling openings face the plate cylinder shafts during printing.

* * * * *